US008356911B2

(12) United States Patent
Neal

(10) Patent No.: US 8,356,911 B2
(45) Date of Patent: Jan. 22, 2013

(54) LED LIGHT SOURCE

(76) Inventor: Andrew T. Neal, Salt Point, NY (US)

( * ) Notice: Subject to any disclaimer, the term of this patent is extended or adjusted under 35 U.S.C. 154(b) by 0 days.

(21) Appl. No.: 13/214,465

(22) Filed: Aug. 22, 2011

(65) Prior Publication Data

US 2012/0069558 A1 Mar. 22, 2012

Related U.S. Application Data

(60) Provisional application No. 61/401,944, filed on Aug. 23, 2010.

(51) Int. Cl.
*F21S 4/00* (2006.01)

(52) U.S. Cl. ..... 362/219; 362/221; 362/225; 362/235; 362/255

(58) Field of Classification Search ..... 362/219, 362/221, 224–225, 235, 249.01–249.02, 362/255, 257, 545, 551, 555, 800
See application file for complete search history.

(56) References Cited

U.S. PATENT DOCUMENTS

2007/0273290 A1* 11/2007 Ashdown et al. ..... 315/113

* cited by examiner

*Primary Examiner* — Meghan Dunwiddie
(74) *Attorney, Agent, or Firm* — Joseph L. Spiegel

(57) ABSTRACT

A lighting source comprises a plurality of LED tubular lighting fixtures having upper and lower ends. Upper and lower mounting caps positioned at the ends of the fixtures have cups for receipt of the fixture ends that locate the fixtures within the caps in a pattern and allow for rotation of the fixtures within the cups. A locking bar extends between the mounting caps, for sealing the ends of the fixtures within the cups against the mounting caps and prevents further rotation of the fixtures. A circuit board located on the upper mounting cap is connected electrically to the LED fixtures. Wires extending from the upper ends of the tubular fixtures pass through apertures in the cups of the upper mounting caps to push connectors on the circuit board for connection to an external DC power source.

3 Claims, 4 Drawing Sheets

LED LIGHT SOURCE

CROSS-REFERENCE TO RELATED APPLICATION

The present application is related to Provisional Application Ser. No. 61/401,944, filed Aug. 23, 2010. This prior application is incorporated herein by this reference and the benefit of its filing date is claimed herein as well.

BACKGROUND OF THE INVENTION

1. Field of the Invention

This invention relates to a lighting source for use in such devices as street lamps and wherein the light source includes a plurality of LED tubular lighting fixtures.

2. Description of the Prior Art

Typical prior art light sources are discharge lamps that have to use a ballast/igniter circuit, lamp holder, which are affected by temperature, humidity, etc.

SUMMARY

A primary object of the present invention is an energy-efficient, environmentally sound RETRO-FIT, low power, long life light source that can operate on low voltage DC.

Another object of the present invention is such a light source that can be directly connected to alternative energy sources, battery backup, which in the event of an emergency, will provide pathway illumination.

Still another object is such a light source that provides output pattern, allowing a user to arrange the output beam in a variety of sectors.

These and other objects, features and advantages are accomplished in accordance with the teachings of the present invention, one illustrative embodiment of which comprises a lighting source including a plurality of LED tubular lighting fixtures having upper and lower ends. Upper and lower mounting caps positioned at the ends of the fixtures, have cups for receipt of the fixture ends that locate the fixtures within the caps in a pattern and allow for rotation of the fixtures within the cups. A locking bar extends between the mounting caps, for sealing the ends of the fixtures within the cups against the mounting caps and prevents further rotation of the fixtures. A circuit board located on the upper mounting cap is connected electrically to the LED fixtures. Wires extending from the ends of the tubular fixtures pass through apertures in the cups of the upper mounting caps to push connectors or terminals on the circuit board for connection to an external DC power source.

BRIEF DESCRIPTION OF THE DRAWING

Other objects, features and advantages of the present invention will be apparent from the following detailed description and accompany drawing, wherein.

DETAILED DESCRIPTION

Figure 1:
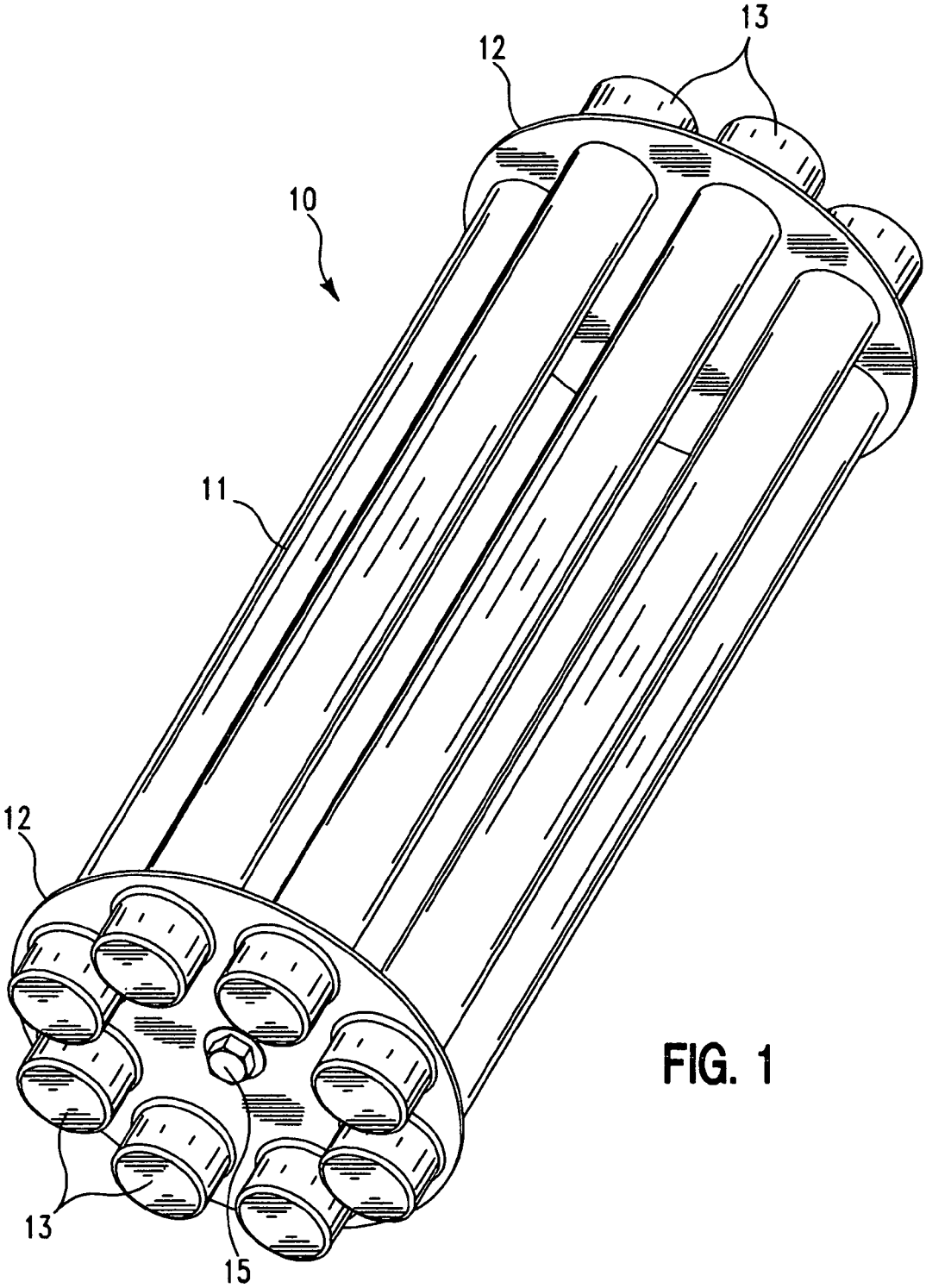
FIG. 1 is a perspective view of the light source of the LED illuminating device of the present invention.

Referring now to the drawing, the light source 10 of the present invention is seen as including a plurality (8 as shown)

of LED tubular lighting fixtures 11. Light source 10 is typically used in street lamps, but can be used in a stand-alone, wide area light, like a pendant (chandelier) type fixture, emergency flood light and the like. The light source 10 can be a retro-fit inside any existing lamp post.

These fixtures 11 or LED tubes include a plurality of LEDs connected in series on a printed circuit board along with a high frequency electronic driver connected in series with the LEDs and adapted to be connected to a DC power source and voltage limiting devices connected in parallel with the LEDs. A heat sink shell and lens bonded to the shell form a water-tight, exterior shell for enclosing the LED bearing circuit boards and directing and delivering light from the LEDs. The heat sink shells block the light in one direction while the lens permits direction of light in another direction. An example of same may be found in my co-pending patent application, U.S. Ser. No. 12/351,569, filed Jan. 9, 2009, entitled "LED Tubular Lighting Fixture" and its description is incorporated by this reference as though set forth at length herein.

Figure 3:
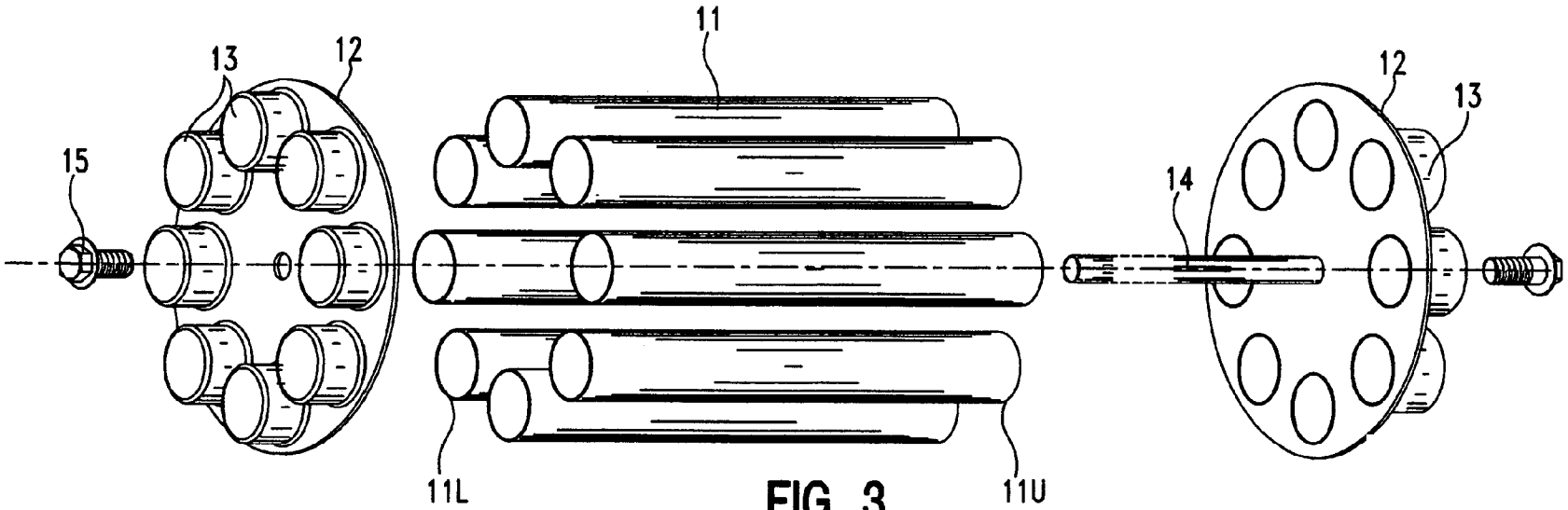
FIG. 3 is an exploded view of the light source of FIG. 1.
Figure 5:
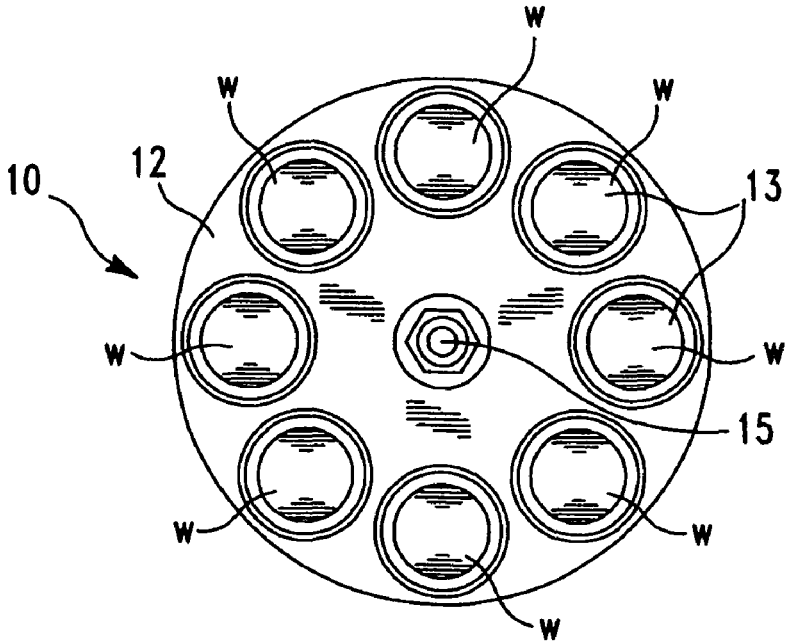
FIG. 5 is a top view of the light source of FIG. 1.

Positioned at either end of the light source 10 are mounting caps 12 with cups 13 located therein. The cups 13 locate the upper 11U and lower 11L ends (FIG. 3) of the tubes 11 in a pattern within the mounting caps 12, allow for sealing the open ends of the tubes 11, permit different numbers of tubes 11 to actually be placed within the light source 10 and allow for rotation of the tubes 11 within the light source 10. Wires W (FIG. 5) from the fixtures 11 extend outwardly from tubes 11 and through the cups 13.

Typically, the pattern is circular, but the tubes 11 can be arranged in a square or triangular pattern, depending on the desired out-beam pattern.

A locking bar 14 extends between the mounting caps 12 and pulls the light source 10 together, seals the ends of tubes 11 within the cups 13 against the mounting caps 12, and prevents rotation of the tubes once in place. The locking bar 14 is tightened against the mounting caps 12 by means of tapping screws 15.

Figure 4:
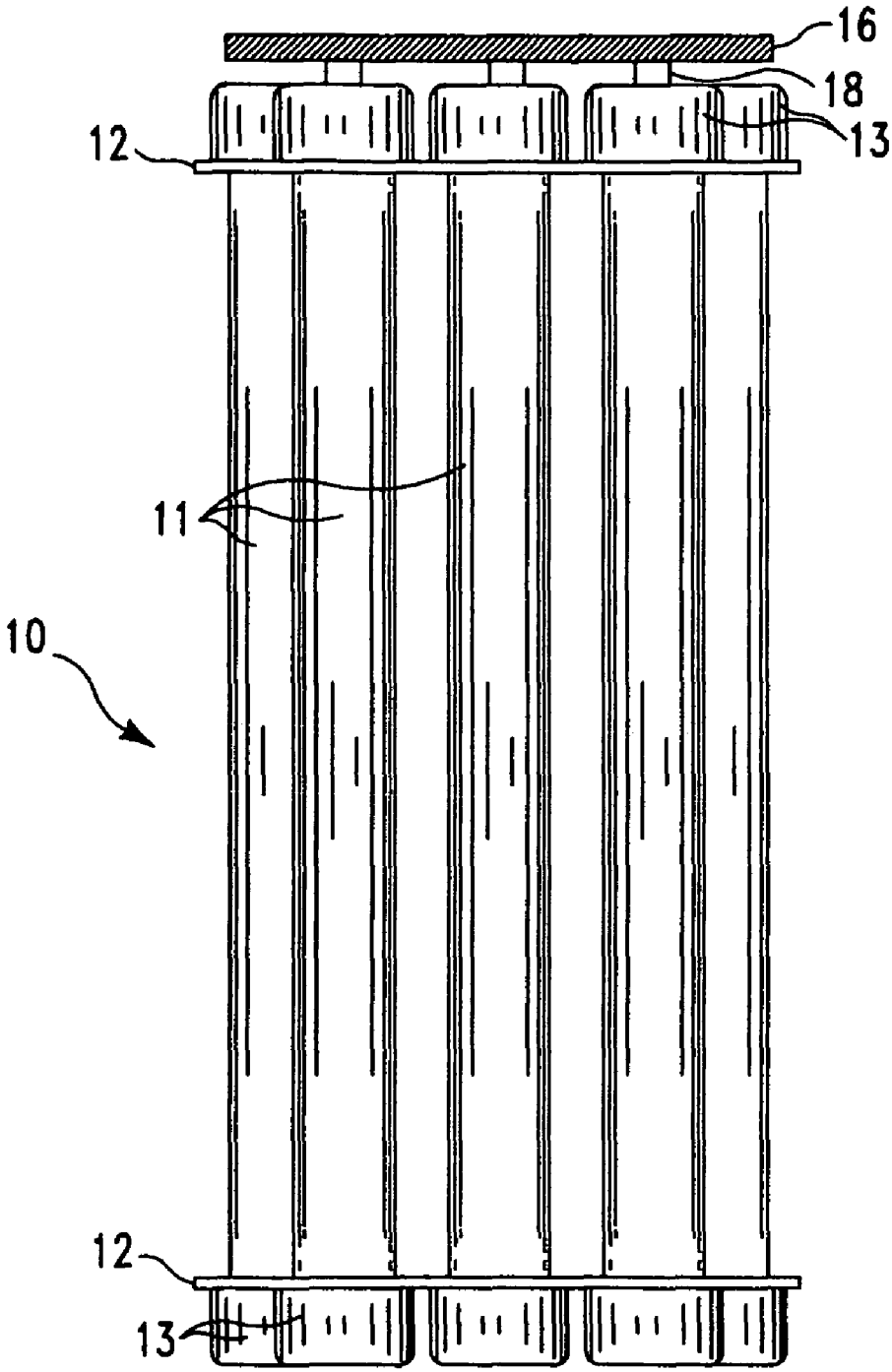
FIG. 4 is a side view of the light source of FIG. 1.
Figure 6:
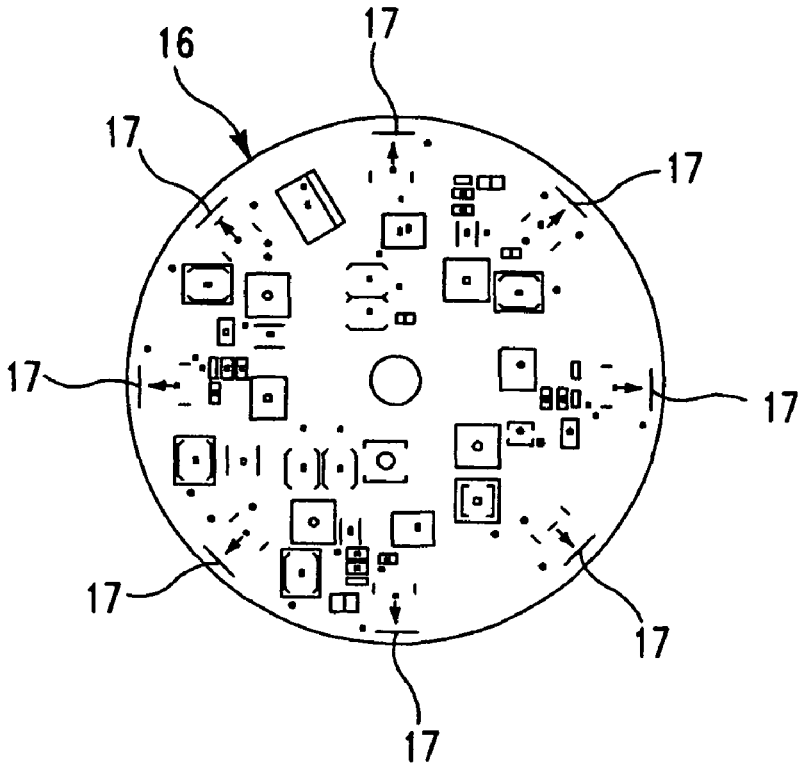
FIG. 6 is a top view of the printed circuit board shown only in FIG. 4.

In a preferred embodiment, a circular circuit board 16 (FIGS. 4 and 5) with push terminals 17 is mounted above the top mounting cap 12, separated from the board 16 by spacers 18. The circuit board 16 provides continuity from the tube circuitry to external power. The cups 13 at the top cap 12 are provided with apertures through which the wiring from the tubes 11 pass, which wiring is terminated in the push terminals 17 that connect into the circuit board 16. One of the circuit board push terminals 17 may then be connected to an external 24 volt DC source, to dimmers, motion sensors, battery backups, etc.

In a preferred embodiment, a single driver circuit is placed on the board, instead of the driving circuits within the individual tubes.

The mounting caps 12 and locking bar 14 are all of light-weight, but rugged plastic.

A toroidal diffuser (not shown), as of white plastic with matted finish, is placed above the top mounting cap 12 so that no light is lost skyward and the light is directed downward to where you want the light source to illuminate.

Circuitry to the light source could be configured so that some of the tubes are energized say, all the time, while the remaining tubes light up due to motion detected by a motion sensor.

In use, with the number of desired fixtures 11 placed in the cups 13 of the mounting caps 12 and with the lenses of the fixtures 11 in a desired position, the wires W of the fixtures 11 are passed through the apertures in the top cups 12 and connected to the push terminals 17 of the circuit board 16. The locking bar 14 tightens the fixtures 11 in place. Where the circuit board 16 is mounted above the top mounting cap 12, the tapping screw 15 will pass through board 16 as well.

The light source 10 may then be mounted on or bracketed to a street lamp post at the tapping screws. Wiring from the push terminals on the circuit board is connected to an external DC source and the light source 10 is now ready for use.

Figure 2:
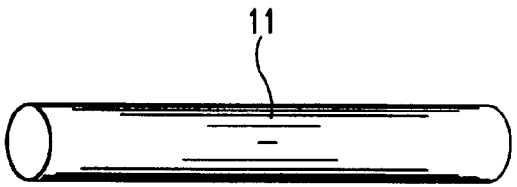
FIG. 2 is a side view of the LED tubular lighting fixture used in the light source of FIG. 1.

In certain instances one may want to have less than the full complement of tubes 11 within the light source 10. An example is when the light source is placed within a lamp post for lighting a pathway in an apartment complex and one doesn't want lamps giving off light in another direction that may spill into the windows of nearby residents. One simply leaves out the tubes in the quadrant where one doesn't want the light to go. Ordinary conduit is placed where the tubes 11 have been omitted. The conduit would look the same as the tubes 11 such as shown in FIG. 2. In this way illumination in an unwanted or unnecessary direction is eliminated, Rotation of the tubes to a desired position also provides directionality to some or all of the fixtures 11 of the light source 10.

It should be obvious that changes, additions and omissions may be made in the details and arrangement of parts without departing from the spirit and scope of the invention as hereinafter claimed.

What is claimed is:

1. A lighting source comprising:

a plurality of LED tubular lighting fixtures having upper and lower ends;

upper and lower mounting caps positioned at the ends of the fixtures, the caps having cups for, receipt of the fixture ends, locating the fixtures within the caps in a pattern and allowing for rotation of the fixtures within the cups;

a locking bar extending between the upper and lower mounting caps, for sealing the ends of the fixtures within the cups against the mounting caps and preventing further rotation of the fixtures; and, a circuit board located above and spaced from the upper mounting cap connected electrically to the LED fixtures.

2. The lighting source of claim 1 wherein the LED fixtures have wires extending from the their ends, the cups of the associated upper mounting caps are apertured and through which the fixture wires pass and the circuit board has a plurality of push connectors connected to the fixture wires and at least one push connector for connecting to an external DC power source.

3. The lighting source of claim 1 including a tapping screw for tightening the locking bar against the mounting caps.

* * * * *